United States Patent [19]

Kajiwara et al.

[11] Patent Number: 4,830,955

[45] Date of Patent: May 16, 1989

[54] SILVER HALIDE PHOTOGRAPHIC LIGHT-SENSITIVE MATERIAL AND METHOD OF PROCESSING THEREOF UTILIZING HYDROXY AZAINDENE COMPOUNDS

[75] Inventors: Makoto Kajiwara; Kaoru Onodera, both of Odawara, Japan

[73] Assignee: Konishiroku Photo Industry Co., Ltd., Tokyo, Japan

[21] Appl. No.: 41,700

[22] Filed: Apr. 21, 1987

[30] Foreign Application Priority Data

Apr. 24, 1986 [JP] Japan ..... 61-95020

[51] Int. Cl.[4] ..... G03C 1/46; G03C 7/26; G03C 7/32; G03C 5/24

[52] U.S. Cl. ..... 430/505; 430/382; 430/489; 430/544; 430/567

[58] Field of Search ..... 430/382, 489, 544, 505, 430/567

[56] References Cited

U.S. PATENT DOCUMENTS 2,956,876 10/1960 Spath et al. ..... 430/382
3,817,756 6/1974 Claes et al. ..... 430/567
4,565,774 1/1986 Kajiwara et al. ..... 430/544

FOREIGN PATENT DOCUMENTS 716327 10/1954 United Kingdom .
2016724 9/1979 United Kingdom .

*Primary Examiner*—Mukund J. Shah
*Attorney, Agent, or Firm*—Jordan B. Bierman

[57] ABSTRACT

The present invention relates to a silver halide photographic light-sensitive material comprising a support, at least one silver halide emulsion layer containing silver halide crystals, the silver chloride content of which being not less than 80 mol %, at least one compound which is represented by general formula [I], of which acid dissociation constant (Ka) and the solubility product (Ksp) with silver ion are not more than $1\times10^{-8}$ and not more than $1\times10^{-10}$, respectively;

[I]

(wherein Z represents a group of atoms necessary to complete a heterocyclic ring) and at least one azaindene compound having at least one hydroxyl group.

13 Claims, No Drawings

SILVER HALIDE PHOTOGRAPHIC LIGHT-SENSITIVE MATERIAL AND METHOD OF PROCESSING THEREOF UTILIZING HYDROXY AZAINDENE COMPOUNDS

FIELD OF THE INVENTION

The present invention relates to a silver halide photographic light-sensitive material, and more particularly, to a silver halide photographic light-sensitive material capable of preventing a fog generation and carrying out a rapid and stable processing.

BACKGROUND OF THE INVENTION

Recently, the provision of a silver halide photographic lightsensitive material is required to carry out a rapid processing and accomplish a superior color reproduction as well as gradation reproduction and carry out a stable photographic processing. Further, it is inexpensive. Above all, a silver halide photographic lightsensitive material capable of rapidly processing a development is in great demand.

Recently, a silver halide photographic light-sensitive material are sequentially developed by automatic developing machines installed at processing laboratories. Processing laboratories are demanded to develop negatives as promptly as possible, for example, in a day. Since the past few years ago, processing laboratories have been demanded to develop negatives as promptly as in several hours.

When a silver halide color photographic light-sensitive material is sequentially processed at a processing laboratory for a long period with a replenisher being replenished, the variation of the replenisher composition causes photographic performance (particularly, gradation) to vary. In recent years, a replenisher is not sufficiently supplied with a developer. This is mainly caused in the above-described situation. When a replenisher is not supplied with a developer sufficiently, followings occur: The accumulation of a development-restraining substance which elutes from a silver halide photographic light-sensitive material (hereinafter referred to as light-sensitive material); the fact that a bleaching agent, fixing solution, and bleach-fix solution contaminate a color developing solution; and the variation of the ion density of bromide contained in the color developing solution. As described above, such a change of a color developer causes an unfavorable photographic performance. Thus, favorable reproductions of color and gradation cannot be obtained. It is almost impossible to prevent bleaching, fixing, and bleach-fix solutions from contaminating a developer even though a strict replenishing rate of a relenisher is determined, and evaporation of the replenisher is prevented, and a light-sentive material is so formed that substance does not elute from the light-sensitive material. The amount of negatives to be developed vary depending on the size of a roller as well as the capacity of automatic developing machines. The amount of a bleach-fix solution which contaminates a developer vary depending on the capacity of developing machines, which is caused by a squeezing manner. When the replenishing rate of the treating solution is reduced, the processing solution does not cycle at a fast speed, with the result that the amount of the bleach-fix solution which contaminates the developer increases.

Various researches have been made to provide a superior means for solving the above-described problem. For example, researches to improve the properties of a conventional light-sensitive material and processing solution have been made to find an appropriate temperature and the optimum pH for a rapid processing, and apply additives such as a developing accelerator, however, neither a rapid and favorable processing nor the reduction of fog generation has been accomplished in spite of energetic researches which have been made so far. Those skilled in the art know that a developing speed is influenced to a great extent by the configuration, size, and composition of particles of a silver halide light-sensitive emulsion and that the composition of silver halide has the greatest influence on a developing speed. It is well known by those skilled in the art that a high silver chloride containing silver halide permits a very rapid processing.

A light-sensitive material in which a silver chloride containing silver halide is capable of carrying out a rapid processing has, however, the disadvantages that a fog is generated and that photographic performance varies in a great extent due to the fact that a bleach-fix solution contaminates a developer. Therefore, the provision of a light-sensitive material which improves this problem is of urgent and great necessity.

Various restrainers to prevent the generation of a fog caused by a silver halide emulsion are known in the art. For example, the one disclosed in U.S. Pat. No. 4565774 is effective for preventing a fog generation and carrying out a rapid processing, however, it is ineffective for improving the variation of photographic performance caused by the contamination of a bleach-fix solution with a developer (hereinafter referred to as BF contamination-caused variation.)

The addition of a mercapto compound to a light-sensitive material can restrain the BF contamination-caused variation to a certain extent, however, in the case of a light-sensitive material in which a silver chloride containing silver chloride is contained, the addition of mercapto group compount thereto is not so effective for restraining the BF contamination-caused variation. If mercapto group compound is added to a light-sensitive material in such a degree as to efficiently restraining the BF contaminated-caused variation, the light-sensitive material degrades in sensitivity to a great extent, and a processing solution is incapable of carrying out a rapid development. Further, an unfavorable desilverization occurs.

SUMMARY OF THE INVENTION

It is therefore an object of the present invention to provide a silver halide photographic light-sensitive material capable of restraining a fog generation and accomplishing a rapid processing.

It is another object of the present invention to provide a photographic light-sensitive material which restrains the variation of photographic performance even though a bleach-fix solution contaminates a developer while the rapid processing is being carried out.

The objects of the present invention can be attained by a silver halide photographic light-sensitive material comprising a support, at least one silver halide emulsion layer containing silver halide crystals, the silver choride content of which being not less than 80 mol %, at least one compound which is reprsented by general formula [1], of which acid dissociation constant (Ka) and the solubility product (Ksp) with silver ion are not more than $1\times10^{-11}$ and not more than $1\times10^{10}$, respectively;

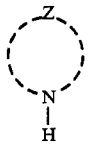

[1]

(wherein Z represents a group of atoms necessry to complete a heterocyclic ring); and at least one azaindene compound having at least one hydroxyl group.

The detailed description of the present invention will be made hereinafter.

The compound according to the present invention is represented by [I] in which Z is selected from optional, arbitrary heterocyclic compounds having the above-described properties. Favorable heterocyclic compounds include benzimidazole ring, benstriazole ring, purine ring, 8-azapuring ring, and pyrazolopyrimidine ring. The acid dissociation constant (Ka) of the compound [I] according to the present invention is less than $1\times10^{-8}$, but preferably, it ranges from $1\times10^{-8}$ to $1\times10^{-13}$.

The acid dissociation constant (Ka) is measured at room temperature. It is, for example, described in the separate volume 2 of "Daiyukikagaku (Organic Chemistry)" published by Asakura Bookstore and the fourth volume of "The theory of Photographic Process" which is written by Mr. T. H. James and published by Macmillan Corp. Several methods of measuring acid dissociation constant are available. One of them is described on pages 524 through 552 of the 11th volume of "Jikken Kagaku Kouza" (Experimental Chemistry Course) published by Maruzen Co., Ltd.

The solubility product (Ksp) of the compound [I], according to the present invention, and silver ion is less than $1\times10^{-10}$. A compound whose solubility product is over this value, namely, a compound whose capability of forming a salt upon a reaction with silver ions is less than that to be accomplished by the compound [I] of the present invention is incapable of displaying the advantage of the present invention. The method of measuring and calculating a solubility product is described on pages 233 through 250 in "Shin Jikken Kagaku Kooza (New Experiment Chemistry Course), 1st volume" published by Maruzen Co., Ltd.

Followings are examples of the compounds [I] according to the present invention, however, other compounds may be used provided that they have the above-described properties.

S-1

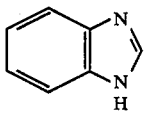

S-2

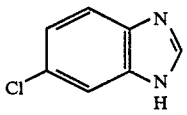

-continued

S-3

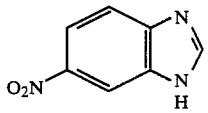

S-4

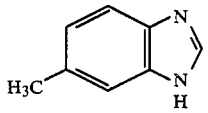

S-5

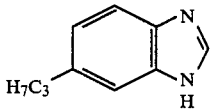

S-6

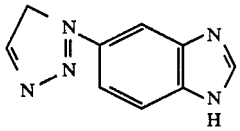

S-7

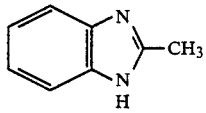

S-8

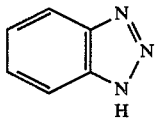

S-9

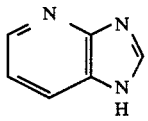

S-10

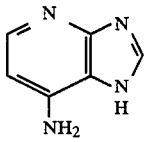

S-11

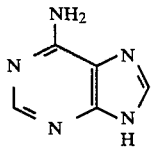

S-12

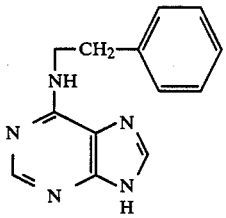

S-13

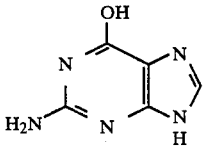

-continued

S-14

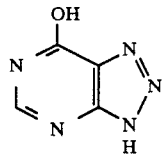

S-15

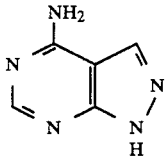

These compounds can be easily formed by those skilled in the art. The methods of synthesizing these compounds are described, for example, "(Shin Jikken Kagaku Koza New Course of Experimental Chemistry)" Vol. 14 (published by Maruzen Co., Ltd.)

Favorably, the amount of the compound [I] to be added to the light-sensitive material of the present invention ranges from $1\times10^{-7}$ to $1\times10^{-1}$ per one mole of silver halide. More favorably, it ranges from $1\times10^{-}$≠to $1\times10^{-2}$. This amount is determined depending on the condition of silver halide emulsion, e.g., the composition, size, and crystal configuration of silver halide particles. The compound is added to the ligh-sensitive material by the conventional photographic method of dissolving it in water, acid or alkali water solution having an optimal pH or organic solvents such as methanol, ethanol and the like.

The compound [I] may be added to silver halide emulsion layer and/or any of the light-sensitive layers. Preferably, the compound is added to the silver halide emulsion layer after a chemical sensitization of silver halide emulsion is completed. When the compound is added to light-sensitive layers other than the silver halide emulsion layer, it may be added between the time the preparation of a light-sensitive coating solution which composes the layers is is started and the time just before the photographic coating solution is applied to these layers.

The advantage according to the present invention cannot be obtained unless the compound [I] in accordance with the present invention is contained in the light-sensitive material. The advantage of restraining the BF contaminated-caused variation cannot be accomplished when the compound of the present invention is added to a developer only.

The preferable azaindene group compounds include hydroxy triazainden, hydroxy tetrazaindene, hydroxy pentazaindene.

Heterocyclic compounds may contain substituents other than hydroxy group, for example, alkyl group, substituted alkyl group, alkylthio group, amino group, hydroxyamino group, alkylamino group, dialkylamino group, arylamino group, carboxyl group, alkoxycarbonyl group, halogen atoms, cyano group.

Followings are representative azaindene compounds, however, other azaindene compounds may be used.

(N-1) 2,4-dihydroxy-6-methyl-1,3a,7-triazaindene
(N-2) 2,5-dimethyl-7-hydroxy-1,4,7a -triazaindene
(N-3) 5-amino-7-hydroxy-2-methyl-1,4,7a-triazaindene
(N-4) 4-hydroxy-6-methyl-1,3,3a,7-tetrazaindene
(N-5) 4-hydroxy-1,3,3a,7-tetrazaindene
(N-6) 4-hydroxy-6-phenyl-1,3,3a,7-tetrazaindene
(N-7) 4-methyl-6-hydroxy-1,3,3a,7-tetrazaindene
(N-8) 2,6-dimethyl-4-hydroxy-1,3,3a,7-tetrazaindene
(N-9) 4-hydroxy-5-ethyl-6-methyl -1,3,3a, 7-tetrazaindene
(N-10) 2,6-dimethyl-4-hydroxy-5-ethyl-1,3,3a, 7tetrazaindene
(N-11) 4-hydroxy-5,6-dimethyl-1,3,3a,7-tetrazaindene
(N-12) 2,5,6-trimethyl-4-hydroxy-1,3,3a, 7-tetrazaindene
(N-13) 2-methyl-4-hydroxy-6-phenyl-1,3,3a, 7-tetrazaindene
(N-14) 4-hydroxy-6-methyl-1,2,3a,7-tetrazaindene
(N-15) 4-hydroxy-6-ethyl-1,2,3a,7-tetrazaindene
(N-16) 4-hydroxy-6-phenyl-1,2,3a,7-tetrazaindene
(N-17) 4-hydroxy-1,2,3a,7-tetrazaindene
(N-18) 4-methyl-6-hydroxy-1,2,3a,7-tetrazaindene
(N-19) 7-hydorxy-5-methyl-1,2,3,4,6-pentazaindene
(N-20) 5-hydroxy-7-methyl-1,2,3,4,5,6-pentazaindene
(N-21) 5,7-dihydroxy-1,2,3,4,6-pentazaindene
(N-22) 7-hydroxy-5-methyl-2-phenyl-1,2,3,4,6pentazaindene
(N-23) 5-dimethylamino-7-hydroxy-2-phenyl -1,2,3,4,6-pentazaindene The amount of the azaindene compounds according to the present invention to be added to a silver halide emulsion depends on the dimension, composition, and configuration of emulsion particles. The amount preferably ranges from $2\times10^{-5}$ to 0.2 mols per one mol of silver halide. The compounds are added to the emulsion in the form of a solution consisting of such as water or alkali water unfarmful to a light-sensitive emulsion.

The advantage according to the present invention can be obtained by adding the azaindene compounds of the present invention to the silver halide emulsion layer and/or layers other than the silver halide emulsion layer, namely, other light-sensitive layers. Neither the position of the compound [I] nor that of the azaindene according to the present invention is specified. Nevertheless, it is most favorable to to add both compounds to the silver halide emulsion layer and the azaindene group compound to the silver halide emulsion layer and the compound [I] to the layers other than the silver halide emulsion layer. The time when the azaindene group compound of the invention is added to the silver halide light-sensitve material is not specified.

The silver halide particle of the present invention consists of more than 80 mol % of silver chloride particles, however, it is more favorable that silver chloride consists of more than 90 mol % of silver chloride. The silver halide layer contains mostly silver bromide other than silver chloride. Depending on use, silver halide layer may contain silver iodide provided that silver iodide is contained therein in less than one mol %.

The silver halide emulsion layer according to the present invention may contain silver halide particles other than those according to the present invention. In this case, however, it is favorable that the mol percent of silver halide particle, according to the present invention, to be contained in the silver halide emulsion layer is more than 50. It is more favorable that the silver halide particles according to the present invention are contained in the silver halide emulsion layer in more than 70 mol %. Most favorably, the silver halide particles of the present invention are contained in more than 80 mol %.

The composition of the silver halide particle according to the present invention may be identical both in the interior and on the the surface thereof. The composition of the interior of the particle may be different from that of the surface thereof. When the composition of the interior of the particle is different from that of the surface thereof, the composition may change either continuously or discontinuously.

The particle diameter of the silver halide according to the present invention is not specified, however, it is favorable that it is in the range from 0.2 μm to 1.6 μm, and more favorably, from 0.25 to to 1.2 μm, whereby a rapid processing can be accomplished, and a favorable sensitivity and other photographic performance can be obtained. The particle diameter can be measured by methods used in the art. Representative methods are described on pages 94 through 122 in chapters A.S.T.M. and Simposium. On. Light. Microscopy of "Particle Size Analysis" which was written by Loveland and published in 1955 and in the second chapter of the third edition of "The Theory of the Photographic Process" which was written by Mees and James and published by MacMillan Corp. in 1966. A particle diameter of silver halide can be measured using the projected area or the approximate value of the particle. If the configuration of a particle is homogeneous, the particle diameter can be fairly correctly expressed in the form of the diameter or the projected area.

The silver halide particle of the present invention may be polydispersed or monodispersed. Favorably, silver halide particle distribution is monodispersed and the coefficient of variation is less than 0.22. More favorably, it is less than 0.15. The coefficient of variation indicates the extent of particle diameter distribution and is expressed by the following equation.

$$\text{Variation coefficient } (S/\bar{r}) = \frac{\text{Standard deviation of particle diameter distribution}}{\text{Average particle diameter}}$$

$$\text{Standard deviation } (S) \text{ of particle diameter distribution} = \sqrt{\frac{\Sigma(\bar{r} - ri)^2 ni}{\Sigma ni}}$$

$$\text{Average particle diameter } (\bar{r}) = \frac{\Sigma niri}{\Sigma ni}$$

where ri indicates the particle diameter of each particle and ni endicates the number of particles. The particle diameter herein means the diameter of spherical silver halide particle. When silver halide particle is cubic or non-spherical, the diameter is calculated by converting the area of the projected image of the particle in terms of a circle image whose area is identical to that of the particle.

The configuration of the silver halide particle of the present invention is not specified. One preferred configuration is a cube having (100) faces as its crystal surface. By utilizing methods disclosed in U.S. Pat. Nos. 4,183,756 and 4,225,666, Japanese Patent Laying-Open Publication No. 1980-26,589, and Japanese Patent Examined Publication No. 1980-42737, and described in "The Journal of Photographic Science" (J. Photogr. Sci) 21 and 39, octahedra, tetradecahedra, and dodecahedra particles are formed to be used as the silver halide particle of the present invention. Particles having twin planes may also be used.

The configuration of silver halide particles according to the present invention may either be homogeneous or unhomogeneous.

The silver halide particles to be contained in the emulsion according to the present invention can be obtained by acid process neutral process or ammonia process. The particles may be grown at once after forming seed particles. The methods of forming seed particles and growing them may be whichever identical or different.

A soluble silver salt is reacted with a soluble silver halide by normal precipitation method, reverse precipitation method, double-jet precipitation method or in combination thereof, however, the double-jet precipitation method is most favorable. PAg-Controlled Double-Jet precipitation method, disclosed in Japanese Patent Laying-Opne Publication No. 1979-48521, which is one of the double-jet precipitation methods may also be utilized.

Thioether which acts as a solvent for silver halide or crystal habit controlling agents such as a compound containing methylcapto group and sensitizing dyes may be used as necessary. Metallic ions may be added to or contained in the silver halide particle to be contained in the emulsion of the present invention using following substances when the particle is formed and/or grown: Cadmium salt, zinc salt, lead salt, thallium salt, iridium salt or complex salt thereof, rhodium salt or complex salt thereof, iron salt or complex salt thereof. Thus, added substance can be formed in the interior of the particle and/or on the surface thereof. A reduction sensitizing nucleus can be formed in the interior of the particle and/or the surface thereof by placing the particle in an appropriate reducing atmosphere.

Unnecessary soluble salts may or may not be removed from the emulsion according to the present invention after silver halide particles are grown. The method of removing the salts can be carried out according to the method described in "Research Disclosure No. 17643".

Silver halide particles of the present invention may be the one which forms a latent image mainly on the surface thereof or the one which forms a latent image mainly in the interior therein. Preferably, the latent image is formed on the surface thereof.

The emulsion according to the present invention is chemically sensitized by conventional methods, that is, sulfur sensitizing method using compounds containing sulfur which is capable of reacting with silver ions or active gelatin, selenium sensitizing method using selenium compounds, reduction sensitizing method using reducing substance, noble metal sensitizing method using such as gold. These sensitizing methods can be used independently or in combination thereof.

The emulsion according to the present invention can be spectrally sensitized in a desired wave range using a sensitizing dye known in the photographic industry. Sensitizing dyes may be used independently or in combination thereof. The emulsion according to the present invention may contain not only a sensitizing dye, but also a dye which does not act as a spectral sensitizer or a hyper-sensitizing agent which does not substantially absorb visible radiation and allow the sensitizing dye to increase its sensitizing function.

Various sensitizing dyes may be used either independently or in combination thereof. Sensitizing dyes to be used advantageously according to the present invention are as follows:

The sensitizing dyes to be contained in a blue-sensitive silver halide emulsion layer are disclosed in West Germany Pat. No. 929,080, U.S. Pat. Nos. 2,231,658, 2,493,748, 2,503,776, 2,519,001, 2,912, 329, 3,656,959, 3,672,897, 3,694,217, 4,025,349, 4,046,572, U.K. Pat. No. 1,242,588, Japanese Patent Examined Publication Nos. 1969-14030, and 1977-24844. The sensitizing dyes to be contained in a green-sensitive silver halide emulsion layer include those of cyanine, merocyanine, and composite cyanine disclosed in U.S. Pat. Nos. 1,939,201, 2,072,908, 2,739,149, 2,945,763, U.K. Pat. No. 505,979. The sensitizing dyes to be contained in a red-sensitive silver halide emulsion layer include those of cyanine, merocyanine, and composite cyanine disclosed in, for example, U.S. Pat. Nos. 2,269,234, 2,270,378, 2,442,710, 2,454,629, and 2,776,280. The sensitizing dyes to be contained both in a green or red-sensitive silver halide emulsion layer include those of cyanine, merocyanine, and composite cyanine disclosed in U.S. Pat. Nos. 2,213,995, 2,493,748, 2,519,001, West Germany Pat. No. 929,080.

These sensitizing dyes may be used independently or in combination thereof. Sensitizing dyes are used in combination for the purpose of hyper-sensitization. The methods of using sensitizing dyes in combination thereof have been disclosed, for example, in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, U.K. Pat. Nos. 1,344,281, 1,507,803, Japanese Patent Examined Publication Nos. 1968-4936, 1978-12375, Japanese Patent Laying-Open Publication Nos. 1977-110618 and 1977-109925.

Compounds known as anti-fog agents or fog-stabilizing agents in photographic industry can be added to the emulsion according to the present invention in order to prevent fog generation during the manufacture of a light-sensitive material, preservation or photographic processing and/or in order to maintain a photographic performance stably. The above-described substance are added to the emulsion during a chemical riping and/or after the chemical riping is compleated, and/or between the time the chemical riping is completed and the time the silver halide emulsion is applied to the lightsensitive material.

The advantage of the present invention is specifically displayed in a light-sensitive material which contains a dye-forming coupler. The advantage can be also obtained by carrying out a color development with a color developer after an imagewise exposure is made.

Tetravalent or bivalent cyanogen dye-image forming couplers of phenol group and naphthol group are representative of cyanogen dye-image forming couplers. Such cyanogen dye-image forming couplers have been disclosed in U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,826, 2,976,146, 3,002,836, 3,419,390, 3,446,622, 3,476,563, 3,737,316, 3,758,308, 3,839,044, U.K. Pat. Nos. 478,991, 945,542, 1,084,480, 1,377,233, 1,388,0243, 1,543,040, Japanese Patent Laying-Open Publication Nos. 1972-37425, 1975-10135, 1975-25228, 1975-112038, 1975117422, 1975-130441, 1976-6551, 1976-37647, 1976-108841, 1978-109630, 1979-48237, 1979-66129, 1979-131931, 1980-32071, 1984-146050, 1984-31953, and 1985-117249

The cyanogen image-forming couplers shown by the following general formulas [E] and [F] are preferably used.

General formula [E]

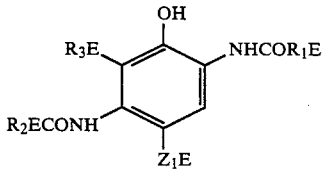

where $R_1E$ shows aryl group, cycloalkyl group or heterocyclic group; $R_2E$, alkyl group or phenyl group; $R_3E$, hydrogen atom, halogen atom, alkyl group or alkoxy group; $Z_1E$, groups which is capable of splitting off upon a reaction with a hydrogen atom, halogen atom or oxidant of a color developing agent of aromatic primary amine group.

General formula [F]

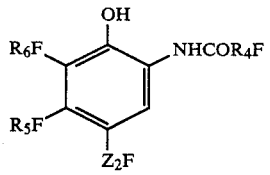

where $R_4F$ shows alkyl group, for example, methyl group, ethyl group, propyl group, butyl group, nonyl group; $R_5F$, alkyl group such as methyl group, ethyl group and the like; $R_6F$, hydrogen atoms, halogen atoms such as fluorine, chlorine, bromine and the like, or alkyl group; $Z_2F$, groups which is capable of splitting off upon a reaction with a hydrogen atom, halogen atom or a color developing agent of aromatic primary amine group.

C-1

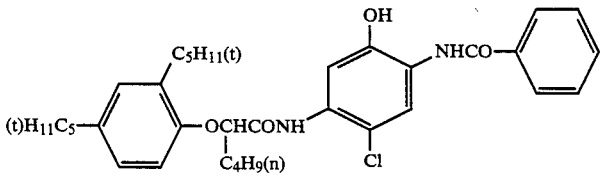

-continued
C-2
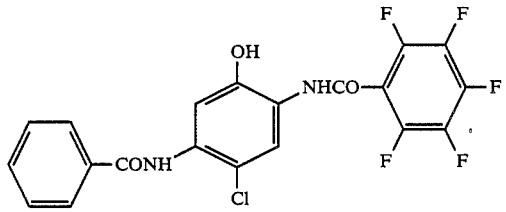
C-3
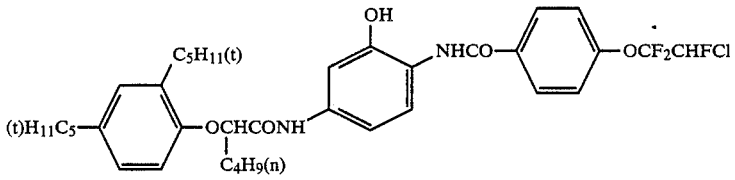
C-4
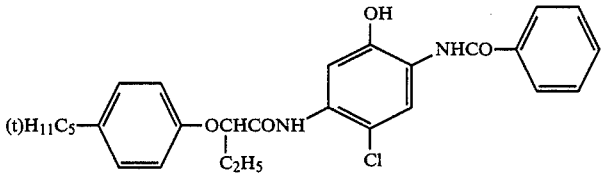
C-5
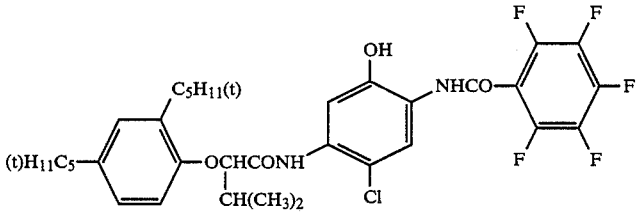
C-6
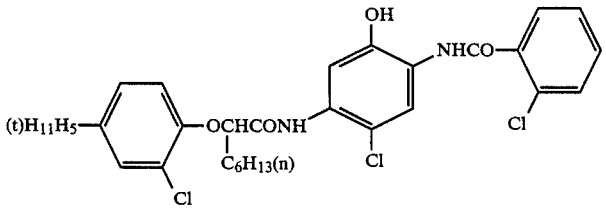
C-7
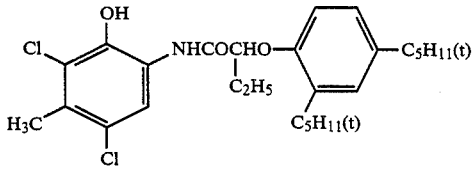
C-8
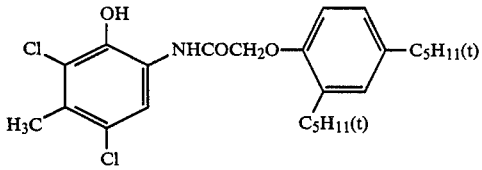
C-9
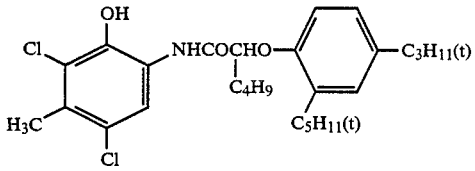

-continued

C-10

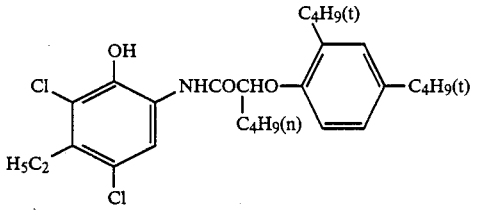

C-11

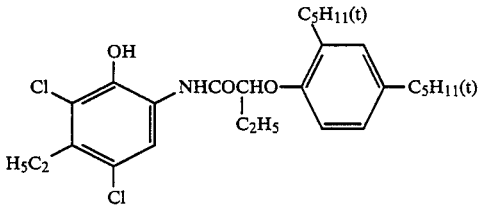

C-12

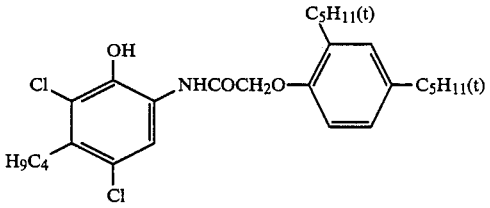

As magenta couplers according to the present invention, the couplers shown by the following formulas [a] and [aI] are preferably used.

General formula [a]

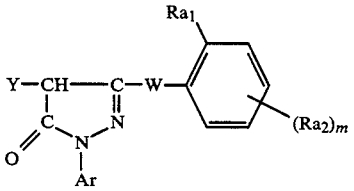

where Ar shows an aryl group; $Ra_1$, hydrogen atom or substituent; $Ra_2$, substituents; Y, hydrogen atoms or substituents which are capable of splitting off upon a reaction of the oxidized product of the color developing agent; W,—NH—,—NHCO—(N atom is bonded with carbon atom of pyrazolone nuecleus) or —NHCONH—; m, integers 1 or 2.

Examples of [a]

m-1

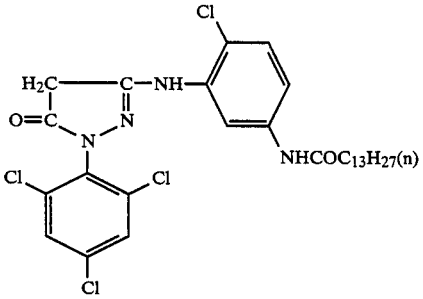

-continued m-2

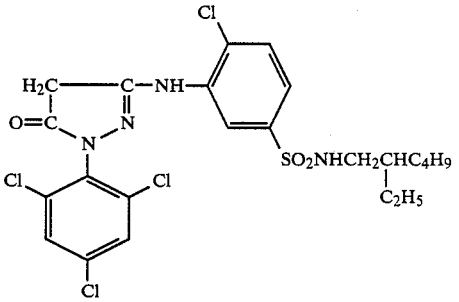

m-3

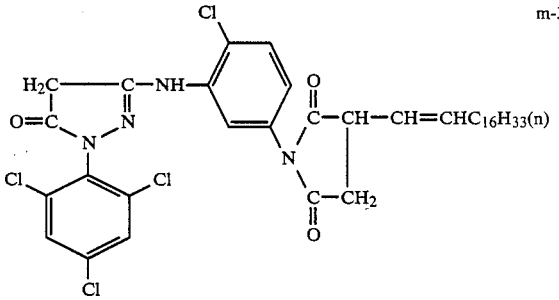

m-4

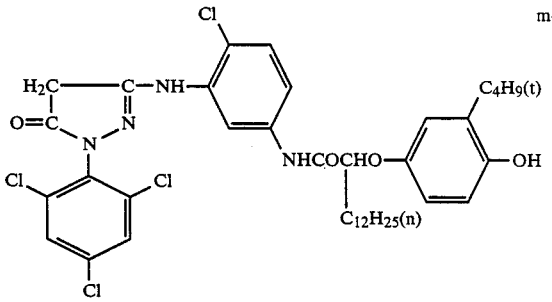

-continued m-5

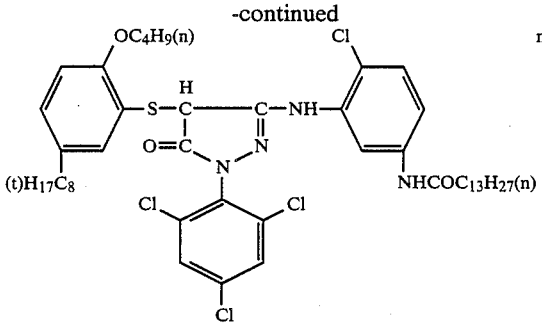

m-6

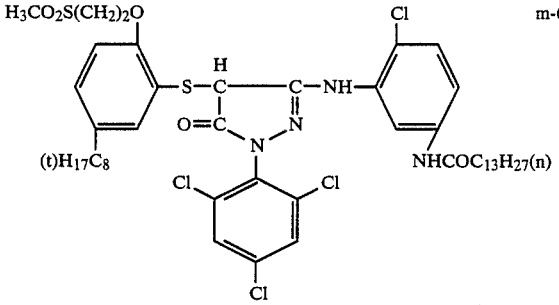

General formula [a]

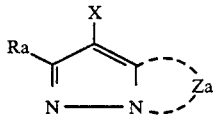

In the magenta coupler shown in the general formula [aI], Za indicates non-metal atoms necessary for forming a heterocyclic ring containing nitrogen. The ring to be formed by the Za may have substituents.

X indicates a substituent which is capable of splitting off upon a reaction with a hydrogen atom or an oxidized product of a color developing agent.

Ra indicates a hydrogen atom or a substituent.

Substituents indicated by Ra include halogen atom, alkyl group, cycloalkyl group, alkenyl group, cycloalkenyl group, alkinyl group, aryl group, heterocyclic group, acyl group, sulfonyl group, sulfinyl group, phosphonyl group, carbamoyl group, sulfamoyl group, cyano group, residue of spiro compound, residue of organic hydrocarbon compound, alkoxy group, aryloxy group, heterocyclic oxy group, siloxy group, acyloxy group, carbamoyloxy group, amino group, acylamino group, sulfonamide group, imide group, ureide group, sulfamoylamino group, alcoxycarbonylamino group, aryloxycarbonyl group, alcoxycarbonyl group, aryloxycarbonyl group, alkylthio group, arylthio group, heterocyclicthio group.

m-7

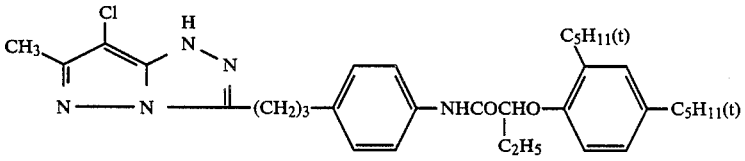

m-8

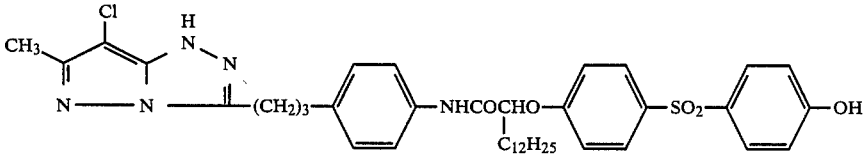

m-9

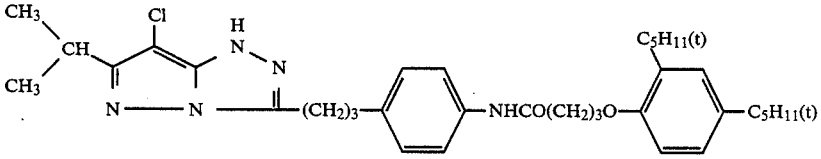

m-10

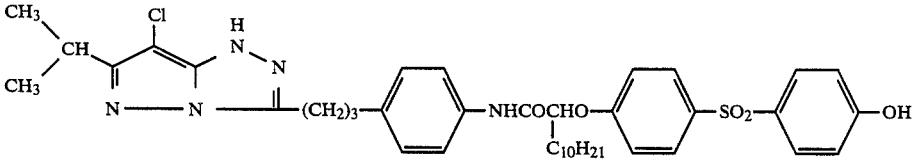

m-11

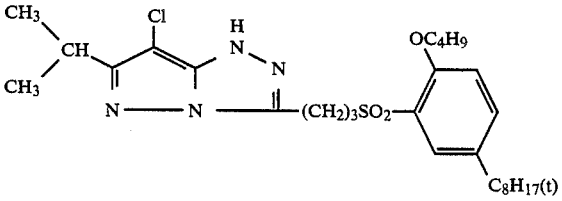

-continued m-12

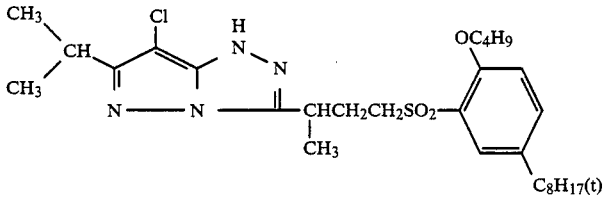

m-13

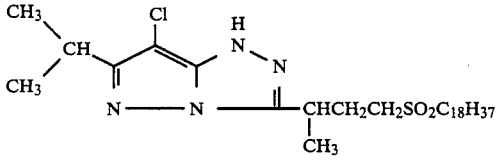

m-14

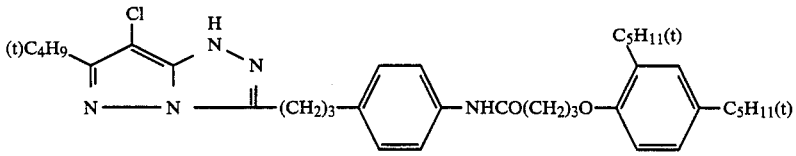

m-15

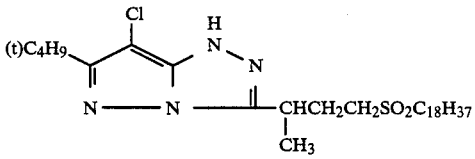

m-16

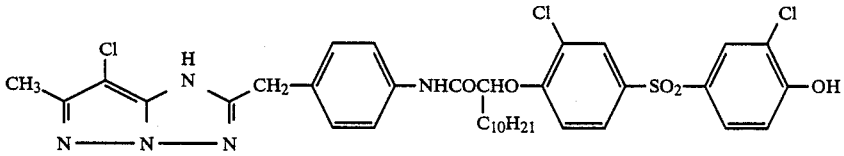

m-17

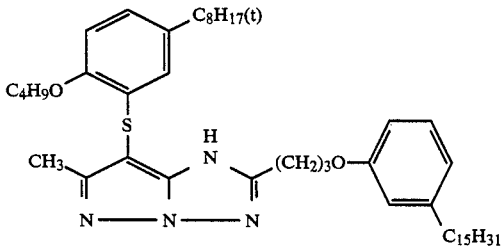

These substances have been disclosed in U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,930,861, 3,930,866, 3,933,500, Japanese Patent Laying-Open Publication Nos. 1974-29639, 1974-111631, 1974-129538, 1975-13041, 1977-58922, 1980-62454, 1980-118034, 1981-38043, 1982-35858, 1985-23855, U.K. Pat. No. 1,247,493, Belgium Pat. Nos. 769,116, 792,525, West Germany Pat. No. 2,156,111, Japanese Patent Examined Publication No. 1971-60479, Japanese Laying-Open Publication Nos. 1984-125,732, 1984-228,252, 1984-162,548, 1984-171,956, 1985-33,552, 1985-43,659, West Germany Pat. No. 1,070,030, and U.S. Pat. No. 3,725,067.

Couplers of acylacetanilide group known in the art are favorably used as yellow dye-forming coupler. Of the couplers, compounds of benzoylacetanilide group and pivaloylacetanilide group are preferred. The yellow couplers to be used according to the present invention have been disclosed in U.S. Pat. No. 1,077,874, Japanese Patent Examined Publication No. 1970-40757, Japanese Patent Laying-Open Publication Nos. 1972-1031, 1972-26133, 1973-94432, 1975-87650, 1976-3631, 1977-115219, 1979-99433, 1979-133329, 1981-30127, U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155, and 4,041,752.

The preferable non-diffusible yellow coupler to be contained in light-sensitive material according to the present invention are preferably expressed by the following general formula [Y].

General formula [Y]

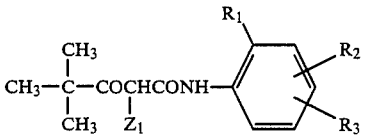

where $R_1$ shows a halogen atom or alkoxy group; $R_2$, alkoxy groups which may contain hydrogen atoms, halogen atoms or substituents; $R_3$, groups which may contain substituents such as acylamino, alkoxycarbonyl, alkylsulphamoyl, allylsulphamoyl, allylsulfonamide, alkylureide, allylureide, succinimide, alkoxy or allyloxy; $Z_1$, groups capable of splitting off when an oxidant of a color developing agent is coupled. Followings are bivalent yellow couplers to be used according to the present invention.

Example compounds (Y-1)

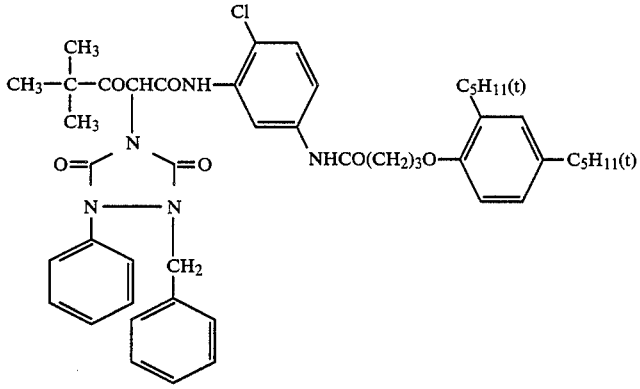

(Y-2)

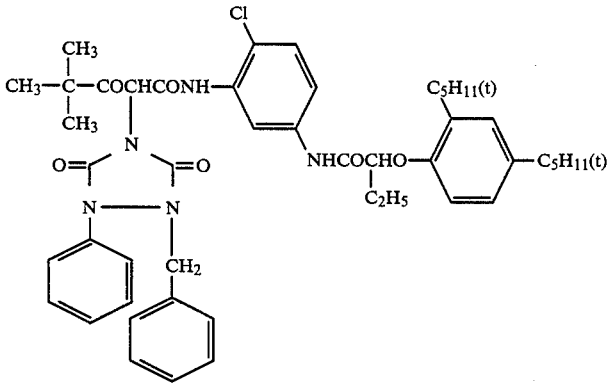

(Y-3)

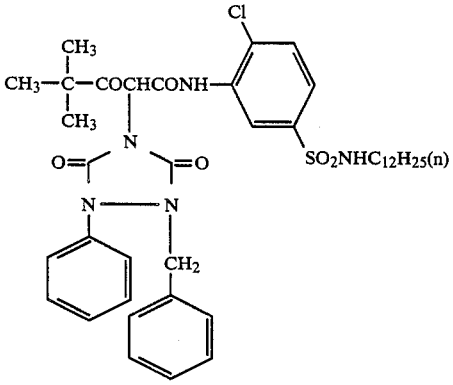

(Y-4)

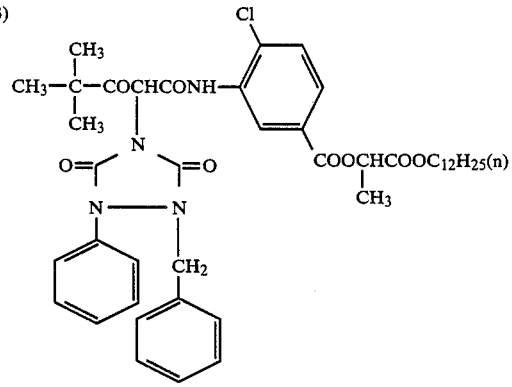

-continued
(Y-5)
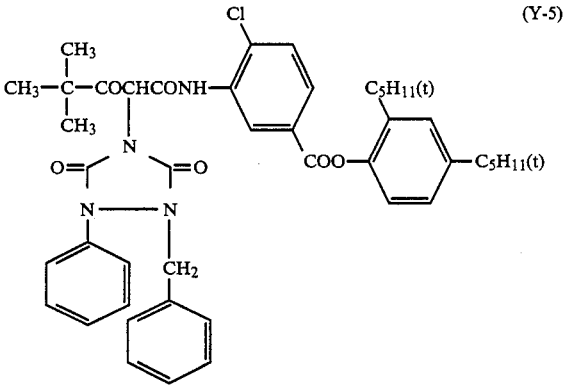
(Y-6)
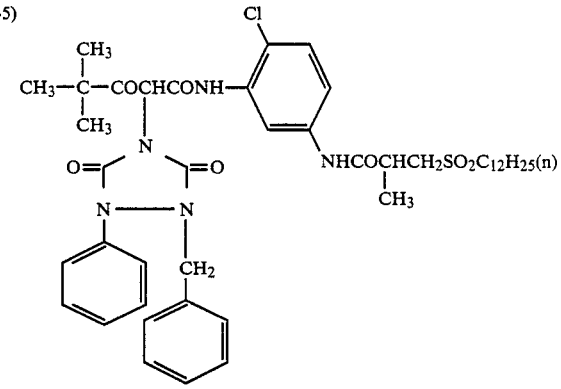
(Y-7)
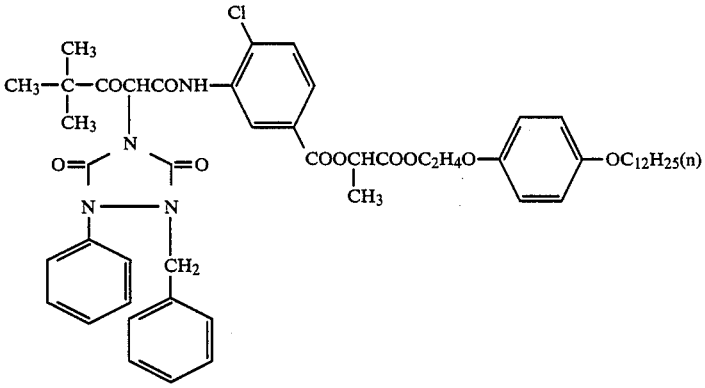
(Y-8)
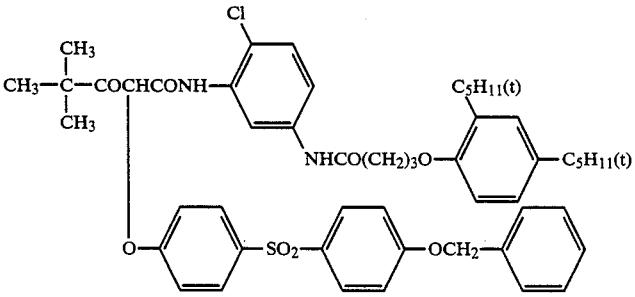
(Y-9)
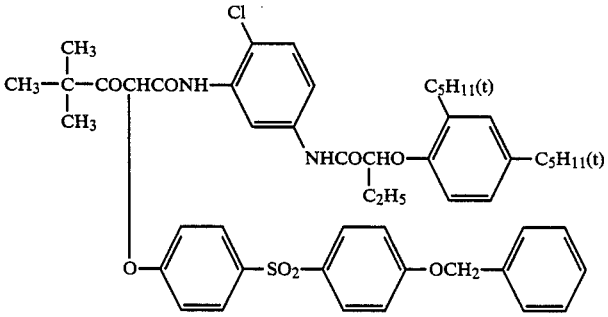

-continued
(Y-10)
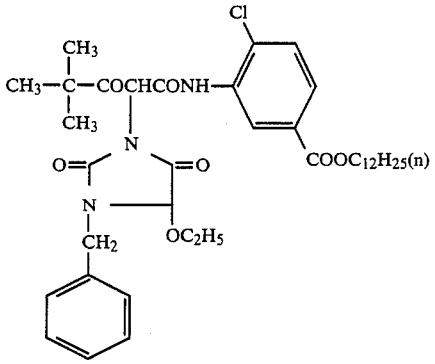
(Y-11)
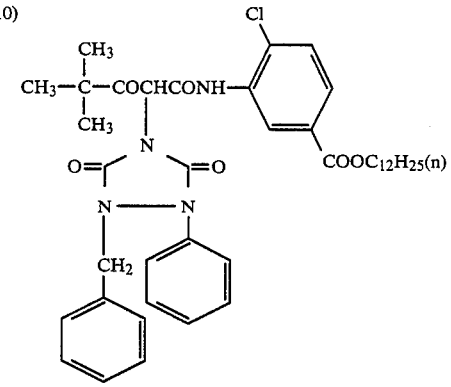
(Y-12)
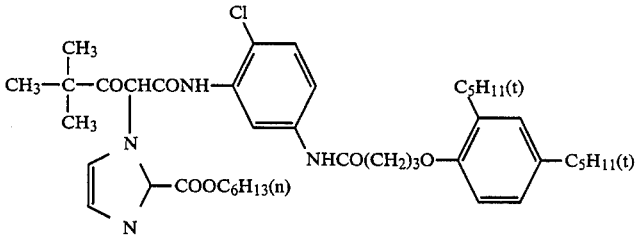
(Y-13)
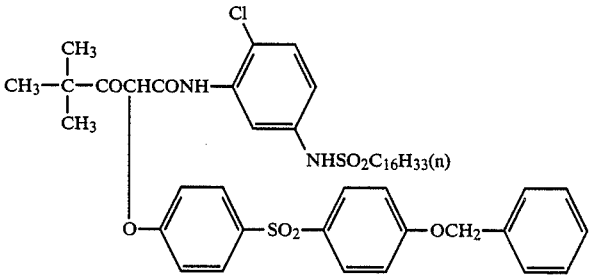
(Y-14)
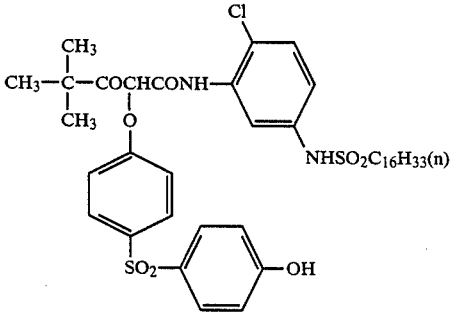
(Y-15)
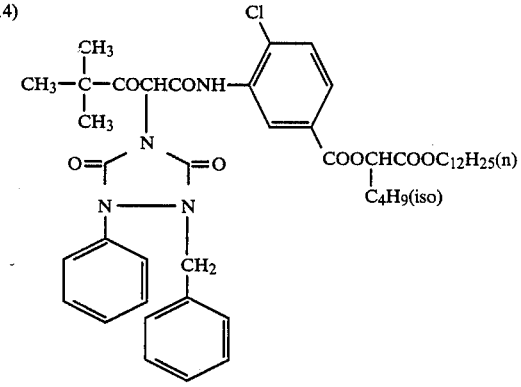
(Y-16)
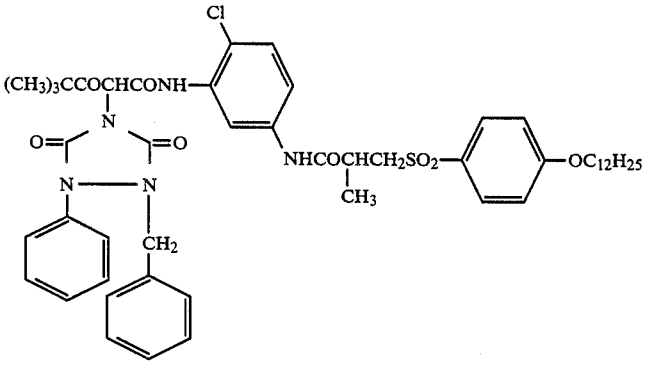

-continued
(Y-17)
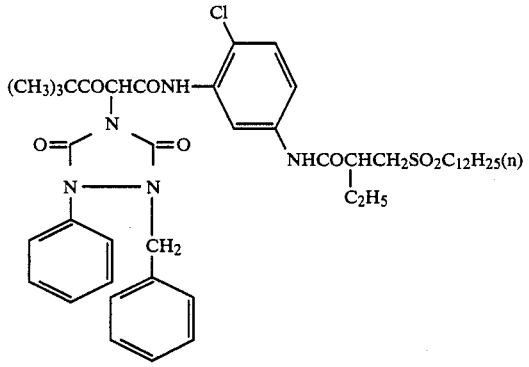
(Y-18)
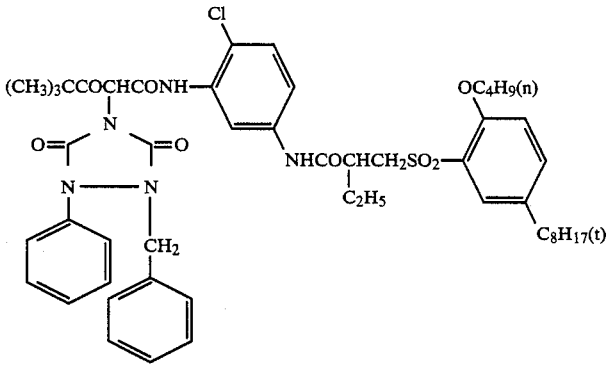
(Y-19)
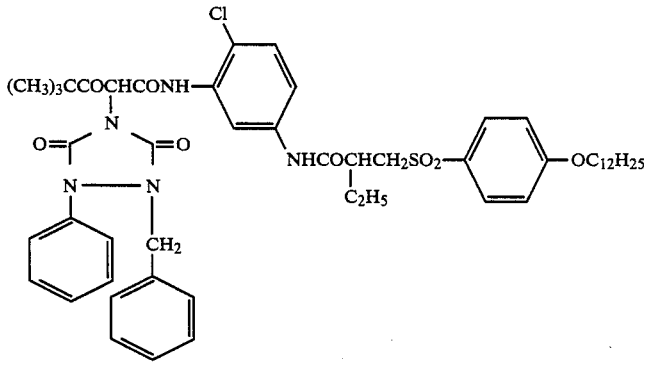
(Y-20)
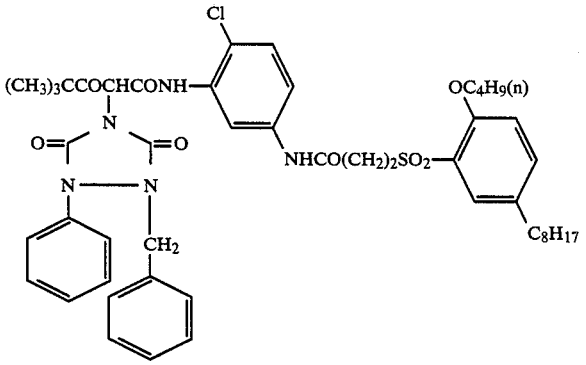

-continued
(Y-21)
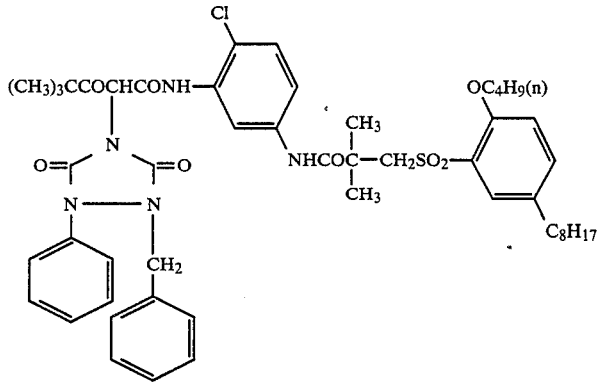
(Y-22)
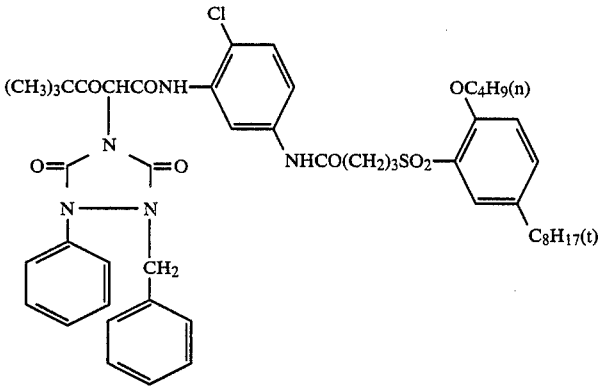
(Y-23)
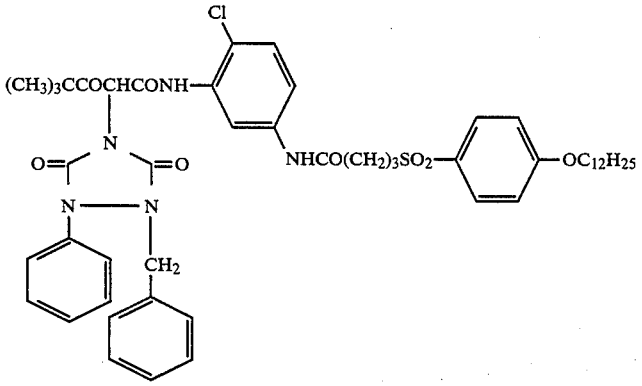
(Y-24)
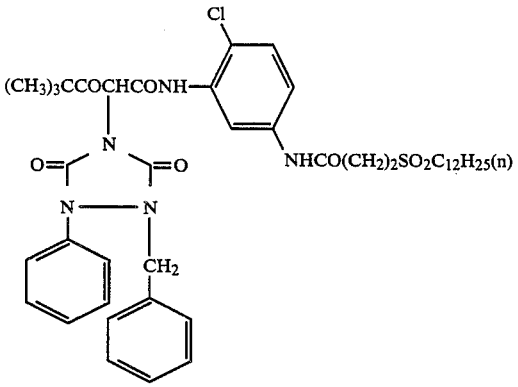

-continued
(Y-25)
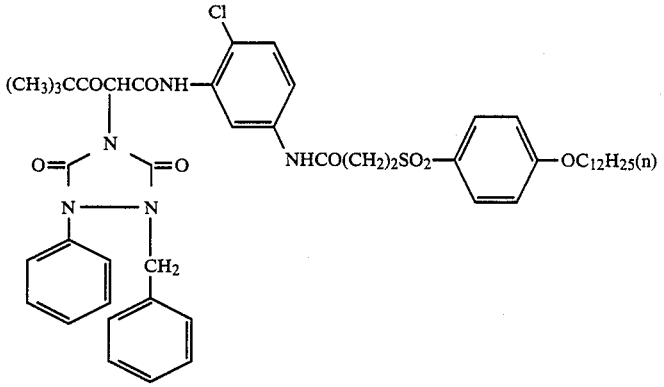
(Y-26)
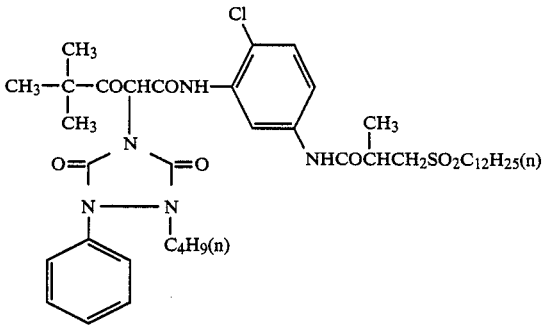
(Y-27)
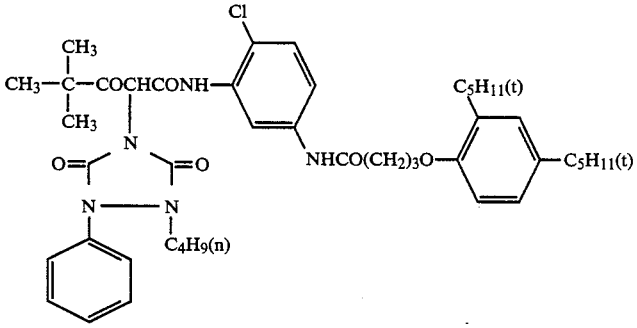
(Y-28)
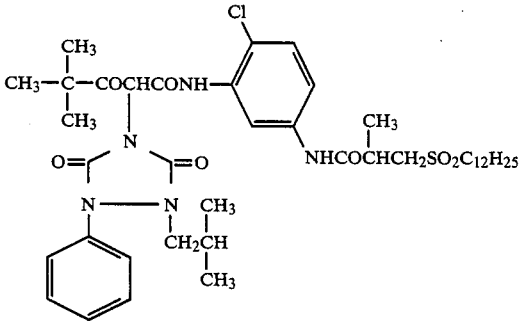
(Y-29)
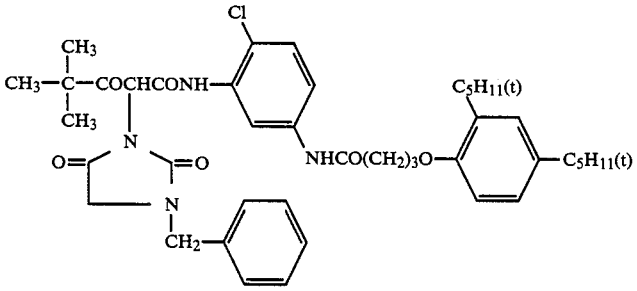

-continued
(Y-30)
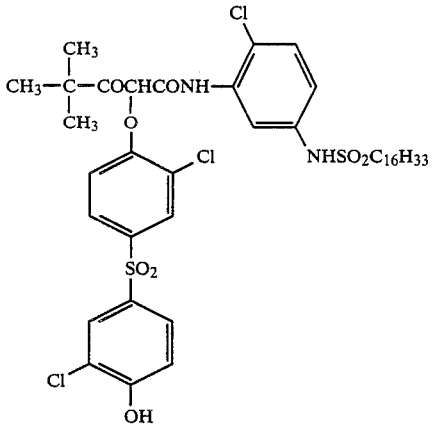
(Y-31)
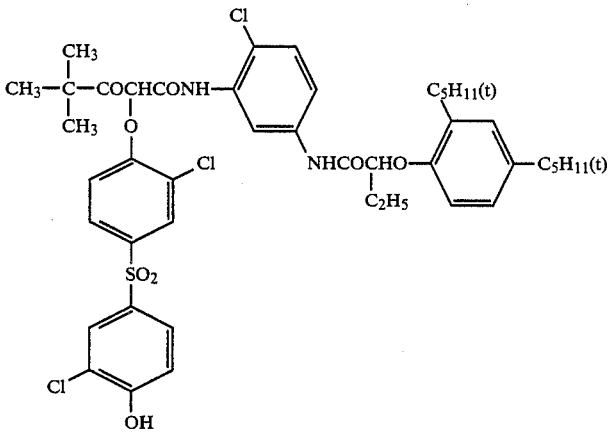
(Y-32)
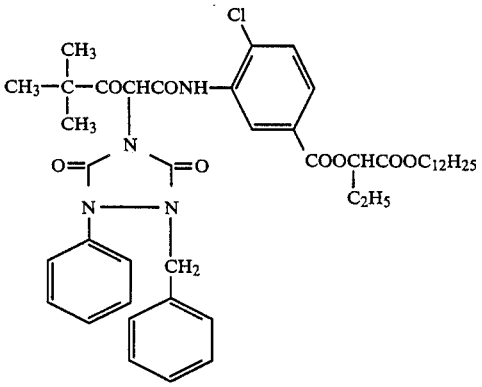
(Y-33)
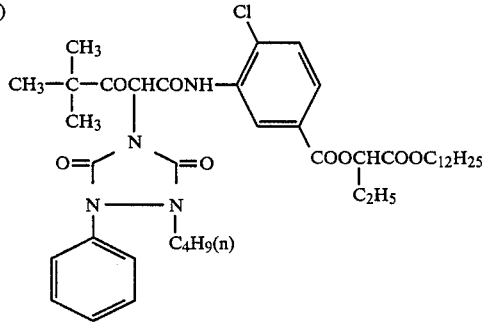
(Y-34)
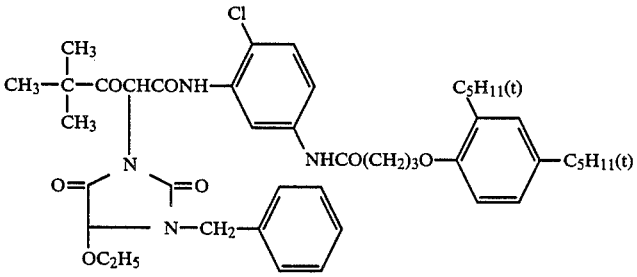

-continued
(Y-35)
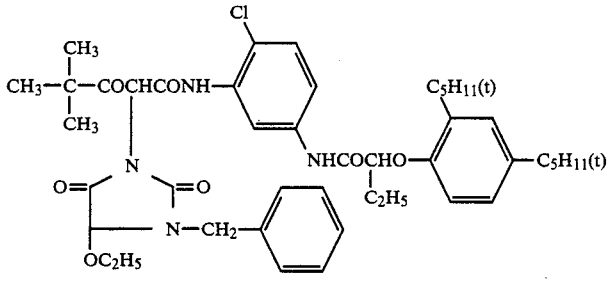
(Y-36)
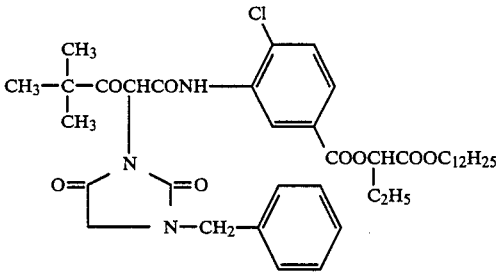
(Y-37)
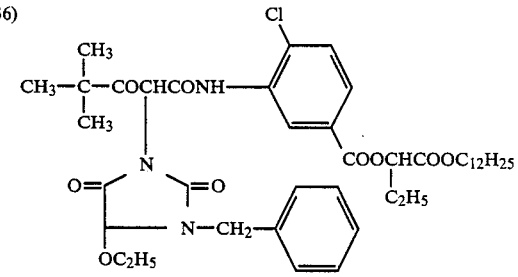
(Y-38)
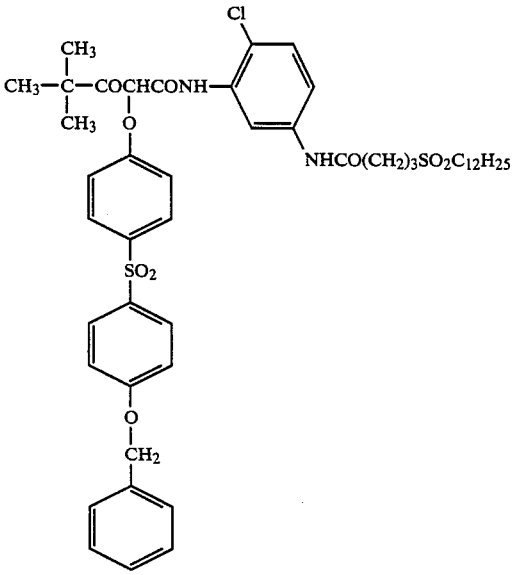
(Y-39)
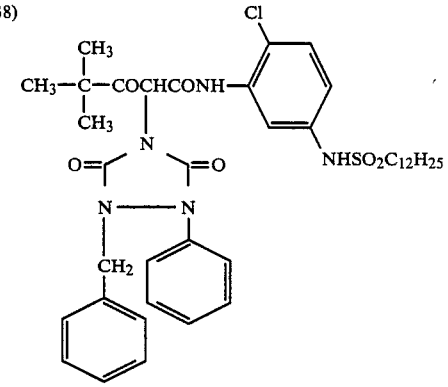
(Y-40)
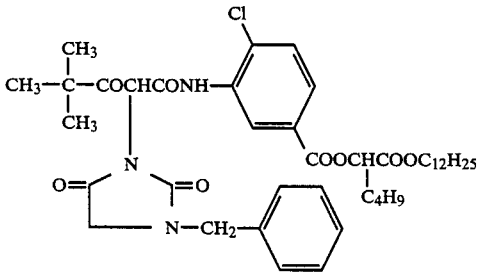
(Y-41)
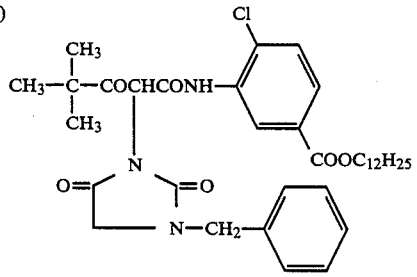

-continued

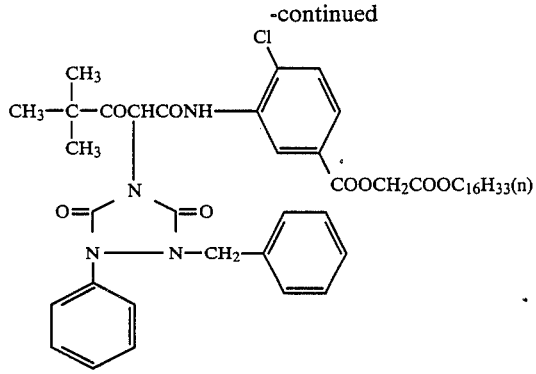

(Y-42)

Gelatin is favorably used as a hydrophilic colloid which disperses the silver halide according to the present invention, however, other hydrophilic colloids may also be used.

Favorable hydrophilic colloids are alkali-treated gelatins and acid-treated gelatins. These gelatins are partially substituted by gelation derivatives such as phthalic gelatin and phenylcarbamoyl gelatin, albumin, agar, gum arabic, alginic acid, partially-hydrolyzed cellulose derivative, partially-hydrolized polyvinyl acetate, polyacrylamide, polyvinyl alcohol, polyvinyl pyrolidone, and copolymers of vinyl compounds thereof.

A light-sensitive material according to the present invention may contain various photographic additives known in the art, for example, ultraviolet absorbing agents (for example, compounds of benzophenone group and benzotriazole group); dye-image stabilizing agents (for example, compounds of phenol group, bisphenol group, hydroxychroman group, bisspirochroman group, hydantoin group, and dialcoxybenzene group); anti-stain agents (for example, hydroquinone drivatives); surface active agents (for example, sodium alkyl naphthalene sulfonate, sodium alkyl benzene sulfonate, alkyl succinate sodium sulfonate, sodium alkyl succinic acid ester sulfonate, polyalkylene glycol), water-soluble anti-irradiation dyes (for example, compounds of azo group, stryl group, triphenylmethane group, oxysonol group, and anthraquinone group); hardners (for example, compunds of halogen S-triazine group, vinylsulfone group, acryloyl group, ethyleneimino group, N-methyol group, expoxy group, and water-soluble aluninum salts); agents for improving coating properties (for example, glycerin, aliphatic polyhydric alcohols, polyner dispersion (latex), solid/-liquid paraffin, and colloidal silica); fluorescent whitening agents (for example, diaminostilbene group compounds); and oil-soluble paints.

Besides a red-sensitive emulsion layer, green-sensitive emulsion layer, and a blue-sensitive emulsion layer, following layers may be provided with a light-sensitive material according to the present invention as necessary: An undercoat layer, intermediate layer, yellow filter layer, ultraviolet absorbing layer, protective layer, halation-prevention layer.

The supports for a light-sensitive material according to the present invention include paper, glass, cellulose acetate, cellulose nitrate, polyester, polyamide, polystyrene. Besides the above supports, a lamination consisting of more than two substrates, for example, a lamination consisting of paper and polyolefin (for example, polyethylene and polypropylene) may also be used as necessary.

Surface of these supports are subjected to following treatments to improve the adhesive properties to a silver halide emulsion layer:

The surfaces are roughed mechanically or with organic solvents; Electron is bombarded onto the surfaces; Flame is applied to the surfaces. Besides these surface treatments, these supports are subjected to undercoat treatments.

A silver halide light-sensitive material according to the present invention can form an image by carrying out the color development treatments known in the art.

The color developing agents according to the present invention to be contained in a color developing solution include those which are known by those skilled in the art and widely used in various color photograph processings. They include derivatives of aminophenol group and p-phenylenediamine group. Since they are stable in the form of salt rather than in free state, they are used as salts such as hydrochlorides or sulfates. The content of these compounds in a color developer is favorably approximately 0.1 g to 30 g per one liter thereof. More favorably, it ranges from approximately 1 g to 15 g per one liter of the color developer.

Developers of aminophenol group include 0-aminophenol. p-aminophenol, 5-amino-2-oxytoluene, 2-amino-3-oxytoluene, 2-oxy-3-amino-1, 4-dimethylbenzene.

The most favorable color developers of primary aromatic amines are selected from compounds of N, N'-dialkyl-p-phenylenediamine group. Alkyl group and phenyl group may be substituted by arbitrary groups. Of the above-described primary aromatic amines, following compounds are very favorably used: N,N'-diethyl-p-phenylenediamine hydrochloride, N-methyl-p-phenylenediamine hydrochloride, N,N'-dimethyl-pphelylenediamine hydrochloride, 2-amino-5-(N-ethyl-N-dodecylamino) toluene, N-ethyl-N-B-methanesulfonamideethyl-3-methyl-4-aminoaniline sulfate, N-ethyl-N-B-hydroxyethylaminoaniline, 4-amino-3-methyl-N,N'diethylaniline, 4-amino-N-(2-methoxyethyl)-N-ethyl-3-methylanilinep-toluenesulf onate.

In addition to the above-described color developers of primary aromatic amin group compounds, compounds known in the art may of course be contained in a color developer to process a silver halide light-sensitive material according to the present invention.

The above-described compounds include alkali agents such as sodium hydroxide, sodium carbonate, potassium carbonate, sulfites of alkali metal, thiocyanates of alkali metal, halides of alkali metal, benzyl alcohol, water softening agent, and thickners.

The pH of a color developer is favorably more than 7. More favorably, it ranges from approximately 10 to 13.

According to the present invention, a developer which does not substantially contain bromine ion is preferred.

This is because bromine ion affects a development speed, that is, a rapid development cannot be accomplished. By a developer which does not substantially contain bromine ions is herein meant a developer which contains less than $1 \times 10^{-3}$ of bromide ions. According to the present invention, a high silver chloride containing silver halide is used.

A silver chloride containing silver chloride containing silver halide may contain silver bromide and silver iodide in addition to silver chloride. In this case, slight amount of silver bromide eludes during a development. The eluded bromine ions are partially substituted by chlorine ions, contained in a high silver chloride containing silver halide, which is not developed in a developer because the solubility product of bromine ions and silver ions is different from that of chlorine ions and silver ions by several figures. Therefore, the eluded bromine ions are held in the silver halide light-sensitive material and undergo the next chemical treatment. So long as slight amount of bromine ions elude in the developer when a high silver chloride containing silver halide is developed, it is impossible to maintain the ion concentration of bromine ions to be 0. As described above, by a developer which does not substantially contain bromine ions is meant that the developer does not allow bromine ions to be contained therein except bromine ions which is unavoidably contaminated therewith. The value $1 \times 10^{-3}$M is the uppermost limit of the concentration of bromine ions which contaminate with the developer.

The silver halide light-sensitive material according to the present invention can be treated by an alkaline activating bath, that is, a color developing agent is contained in a hydrophilic colloid layer in order to act as a color developing agent or as the presursor thereof. The precursor of the color developing agent is a compound which is capable of forming a color developing agent in an alkaline solution. Precursors of a color developing agent include a Schiff' base type with an aromatic aldehyde derivative, complexes of polyvalent metal ions, derivatives of imido phthalates, derivatives of amido phosphates, reactants of sugaramin, urethane-type. The precursors of these primary aromatic amin color developing agents have been disclosed in U.S. Pat. Nos. 3,342,599, 2,507,114, 2,695,234, 3,719,492, 803,783, 3,719,492, U.K. Pat. No. 803,783, Japanese Patent Laying-Open Publication Nos. 1978-185628, 1979-79035, and Research Disclosure Magazine Nos. 15159, 12146, and 13924. It is necessary to add the color developing agents of aromatic primary amine or the precursors thereof in such an amount that enough coloring can be obtained when an activation treatment is carried out. This amount is much different depending on light-sensitive materials, however, it is normally in the range from 0.1 mols to 5 mols per one mol of silver halide. Preferably, it is in the range from 0.5 to 3 mols per one mol of silver halide. These color developing agents or the precursors thereof can be used independently or in combination thereof. The color developing agents or precursors are contained in a light-sensitive material in the form of a solution of water, methanol, ethanol, acetone or the like. The solution may be added to the light-sensitive material in the form of an emulsificated dispersion solution in which an organic solvent, having high boiling points, such as dibutyl phthalate, dioctyl phthalate, tricresyl phosphate or the like is contained. As described in "Research Disclosure No. 14850", they may be added to a light-sensitive material by impregnating them in a latex polymer.

The silver halide light-sensitive material according to the present invention is subjected to a bleaching and fixing after a color development is carried out. A bleaching may be carried out simultaneously with a fixing. Compounds consisting of polyvalent metals such as iron (III), cobalt (III), copper (II) and the like are preferred as bleaching agents. Above all, the complex salts comprising the cations of these polyvalent metals and organic salts are used independently or in combination thereof. They include aminopolycarboxylic acid such as ethylenediaminetetraacetic acid, nitrilotriacetic acid, N-hydroxyethylethylenediaminediacetic acid; metal complex salts such as malonic acid, tartaric acid, malic acid, diglycolic acid, dithioglycolic acid. Besides these compounds, ferricyanides and dichromates are also used as bleaching agents independently or in combination thereof.

Soluble complexing agents which solubilize silver halide as a complex salt are used as a fixing agent. The soluble complexing agents include sodium thiosulfate, ammonium thiosulfate, potassium thiocyanate, thiourea, thioether and the like.

The silver halide light-sensitive material according to the present invention is washed with water after it is subjected to a fixing. The light-sensitive material may be stabilized instead of water washing or stabilization may be carried out simultaneously with a water washing. Stabilizing agents to be used for subjecting the light-sensitive material to a stabilization treatment may contain pH adjustor, adjustors, chelating agents, and phangilicides. The specific method of forming a stabilizing agent has been disclosed in Japanese Patent Laying-Open Publication No. 1983-134,636.

EXAMPLES

The silver halide light-sensitive material according to the present invention will be described by way of examples, however, modifications of the present invention are possible.

EXAMPLE 1

Adjustment of Silver Halide Emulsion EM-A (silver halide)

Solutions of silver nitrate and sodium chloride were added to a non-active gelatin water solution by double-jet precipitation method. It took 60 minutes to form a mixture. The temperature was 50° C. pAg was 7.0.

The mixture thus formed was subjected to a desalination and water-washing to obtain EM-A by a conventional method. The EM-A consisted of cubic silver halide particles whose average diameter was 0.8 μm.

Comparison Emulsion EM-B (Silver chloro-bromide)

Solutions of silver nitride, sodium chloride, and potassium bromide were added to a non-active gelatin solution by double-jet precipitation method at 60° C. pAg was 5.5.

The mixture thus formed was subjected to a desalination and water-washing to obtain EM-B.

EM-B consisted of cubic silver chloro-bromide particles (which contain 20 mol percent of silver halide) whose average diameter was 0.8 μm.

Sodium thiosulfate was added to EM-A and EM-B to carry out ion sensitization. The mixture thus formed was spectrally sensitized by a sensitization dye [SD-1].

After subjecting the mixture to sulfur sensitization, compounds listed in Table 1 were added to the mixture. Yellow coupler-Y-4 which was dissolved in dioctyl phthalate solution was added to silver halide at the ratio of 0.4 mols of the former to one mol of the latter. Thereafter, 0.4 g/m$^2$ (in metal silver equivalent) of silver and 0.2 g/m$^2$ of gelatin were applied to a polyethylene-coated sheet. Gelatin was applied to the sheet in the amount of 3.0 g/m$^2$.

Each of the samples thus formed were subjected to a wedge exposure with a KS-7 type sensitometer manufactured by Konishiroku Photo Industry Co., Ltd. to make evaluations shown below. Evaluation of Rapid Processing Performance Exposing agent samples were treated according to the color developing process shown below.

Processing Procedure

| | temperature | Period of time |
|---|---|---|
| Color development | 34.7 ± 0.3° C. | 20, 40, and 50 seconds |
| Bleach-fix | 34.7 ± 0.5° C. | 50 seconds |
| Stabilization | 30–34° C. | 90 seconds |
| Dry | 60–80° C. | 60 seconds |

Color Developing Solution [A]

Pure water: 800 ml
Ethylene glycol: 10 ml
N,N-diethylhydroxylamine: 10 g
Potassium chloride: 2 g
N-ethyl-N-B-methanesulfoneamidoethyl -3-methyl-4-aminoaniline sulfate: 5 g
Potassium tetrapolyphosphate: 2 g
Potassium carbonate: 30 g
Fluorescent bleach (4, 4'-diaminostilbendi sulfonic acid derivative): 1 g Water was added to make one liter solution which was adjusted to pH 10.08.

Bleach-fix Solution

Ethylenediaminetetraaccetic ferrous acetic Ammonium dyhidride: 60 g
Ethylenediaminetetraacetic acid: 3 g
Anmonium thiosulfate (70% solution): 100 ml
Anmonium sulfite (40% solution): 27.5 ml Potassium carbonate or glacial acetic acid was added to adjust the solution to pH 7.1, and then, water was added to make it one liter.

Stabilizing agent 5-chloro-2-methyl-4-isothiazoline-3-one: 1 g
1-hydroxyethylidene-1,1-diphosphonic acid: 2 g Water was added to make one liter solution and the solution was adjusted to pH 7.1 by adding sulfuric acid or potassium hydroxide.

After samples were formed, they were subjected to sensitometry test with a PDA-65 densitometer manufactured by Konishiroku Photo Industry Co., Ltd.

Table 1 shows the minimum densities (D min) and gradations (γ) measured at each development period, where γ shows the gradations, expressed by the inverse numbers of the difference between logarithms of the light exposure amounts, to obtain the densities 0.8 and 1.8.

The greater the γ was, the higher the contrast was.

Evaluation of BF Contamination-caused Variation

Color developing solutions [B] and [C] were prepared by adding the above-described bleach-fix solutions in the amount of 0.1 ml/1 and 0.2 ml/1, respectively to the above-described color developing solution [A]. The samples were processed by the color developing solutions [A], [B], and [C] according to the above-described color development processing procedure. It took 50 seconds to carry out developments.

The color developing solutions were subjected to sensitometry test with a PDA-65 densitometer. Table 1 shows the result by symbols $\Delta\gamma_B$ and $\Delta\gamma_C$ The $\Delta\gamma_B$ and $\Delta\gamma_C$ indicate the difference between γ measured when samples were processed by the color developing solution [B] or [C] and γ measured when they were processed by [A]. The greater this value was, the larger the BF contaminated-variation was.

TABLE 1

| Sample No. | Non-processed emulsion | Added compound (added amount g/mol Ag X): Compound of the invention [I] | Azaindone compound of the invention | Other compound | Rapid processing performance: 20 seconds γ | 20 seconds Dmin | 40 seconds γ | 40 seconds Dmin | 60 seconds γ | 60 seconds Dmin | BF contanination-caused variation $\Delta\gamma_B$ | $\Delta\gamma_C$ | |
|---|---|---|---|---|---|---|---|---|---|---|---|---|---|
| 1 | EM-A | — | — | — | 3.28 | 0.10 | 3.72 | 0.37 | — | 0.81 | —*1 | —*1 | Comparison |
| 2 | EM-A | — | — | Comparison compound - 1 (0.05 g) | 1.12 | 0.03 | 1.47 | 0.03 | 2.33 | 0.04 | 0.32 | 0.68 | Comparison |
| 3 | EM-A | — | N-11 (1.5 g) | — | 3.18 | 0.08 | 3.85 | 0.23 | 3.89 | 0.70 | 0.42 | —*1 | Comparison |
| 4 | EM-A | S-1 (0.2 g) [Ka = $2 \times 10^{-12}$, Ksp = $3.2 \times 10^{-12}$] | — | — | 3.22 | 0.04 | 3.75 | 0.04 | 3.78 | 0.05 | 0.42 | 0.78 | Comparison |
| 5 | EM-A | S-1 (0.2 g) | N-11 (1.5 g) | — | 3.26 | 0.04 | 3.89 | 0.04 | 3.92 | 0.04 | 0.13 | 0.26 | Invention |
| 6 | EM-A | S-3 (0.1 g) [Ka = $4.9 \times 10^{-11}$, Ksp = $6.3 \times 10^{-13}$] | N-11 | — | 3.16 | 0.04 | 3.65 | 0.04 | 3.68 | 0.04 | 0.14 | 0.27 | Invention |
| 7 | EM-A | S-8 (0.25 g) [Ka = $5 \times 10^{-9}$, Ksp = $4 \times 10^{-14}$] | N-11 | — | 3.22 | 0.04 | 3.73 | 0.04 | 3.79 | 0.04 | 0.14 | 0.26 | Invention |
| 8 | EM-A | S-11 (0.1 g) [Ka = $1.6 \times 10^{-10}$, Ksp = $3.2 \times 10^{-13}$] | N-11 | — | 3.33 | 0.04 | 3.94 | 0.04 | 3.98 | 0.04 | 0.12 | 0.25 | Invention |
| 9 | EM-A | S-11 (0.1 g) | N-6 (2.5 g) | — | 3.08 | 0.04 | 3.56 | 0.04 | 3.60 | 0.04 | 0.14 | 0.26 | Invention |
| 10 | EM-A | S-11 (0.1 g) | N-4 (1.0 g) | — | 3.35 | 0.03 | 3.96 | 0.04 | 3.99 | 0.04 | 0.12 | 0.23 | Invention |
| 11 | EM-A | S-11 (0.1 g) | N-4 | KBr (0.3 g) | 3.00 | 0.03 | 3.50 | 0.04 | 3.56 | 0.04 | 0.06 | 0.15 | Invention |
| 12 | EM-A | — | N-4 | Comparison compound - 2 (2 g) [Ka = $6.3 \times 10^{-8}$] | 3.21 | 0.06 | 3.76 | 0.14 | 3.80 | 0.53 | 0.33 | 0.68 | Comparison |
| 13 | EM-B | S-11 (0.1 g) | N-4 | — | 1.85 | 0.03 | 2.57 | 0.03 | 3.19 | 0.04 | 0.20 | 0.36 | Comparison |

*1Fog was generated in large quantities in a color developing solution to which a bleach-fix solution was added, and as such, evaluation is impossible.
Comparison compound - 1; 1 - phenyl - 5 - mercaptotetrazole
Comparison compound - 2; imidazole Table 1 indicates the followings:

In sample 1 consisting of the emulsion EM-A wherein neither the compound [I] nor the azaindene group compound of the present invention was contained, fog was generated in large quantities. In sample 2 to which the comparison compound -1 (not according to the present invention) well known as a restrainer, no fogging was generated, however, the development speed was very slow. Further, the BF contamination-caused variation was large. Sample 3 which contained the azaindene group compound of the present invention was ineffective fog restraining fog generation. In sample 4 which contained the compound [I] of the present invention, fog generation was restrained and a rapid processing was accomplished, however, the efficiency for restraining the BF contamination-caused variation was inferior. In sample 12 which is shown by the general formula [I] and contained the comparison compound -2 not according to the present invention and the azaindene group compound according to the present invention, fog was generated in large quantities and the efficiency for restraining the BF contamination-caused variation was inferior. In sample 13 which contained the emulsion EM-B, development speed was slow, i.e., rapid processing performance was inferior. In samples 5 through 11 according to the present invention, fog generation was restrained to a great extent and rapid processings were accomplished, and further, the efficiency for restraining the BF contamination-caused variation was superior.

Example 2

Coating samples were prepared after they underwent sulfur sensitization and spectral sensitization in the same manner as that of Example 1 using EM - A except that the compound [I] and the azaindene group compound according to the present invention were added to the layers of the samples as shown in Table 2.

The properties of these samples were evaluated according to the manner as described in Example 1. The result is shown in Table 2.

TABLE 2

| Sample No. | Added compound (Added amount g/mol Ag X) Silver halide emulsion layer | Protective layer | Rapid processing 20 seconds γ | Dmin | 40 seconds γ | Dmin | 60 seconds γ | Dmin | BF contamination-caused variation $\Delta\gamma_B$ | $\Delta\gamma_C$ |
|---|---|---|---|---|---|---|---|---|---|---|
| 14 | 4 S-12 (0.1 g) N-4 (1.0 g) | — | 3.17 | 0.04 | 3.68 | 0.04 | 3.73 | 0.04 | 0.14 | 0.26 |
| 15 | — | S-12 (0.3 g) N-4 (1.5 g) | 3.20 | 0.04 | 3.70 | 0.05 | 3.75 | 0.05 | 0.20 | 0.31 |
| 16 | S-12 (0.1 g) | N-4 (1.5 g) | 3.20 | 0.04 | 3.65 | 0.04 | 3.70 | 0.04 | 0.18 | 0.28 |
| 17 | N-4 (1.0 g) | S-12 (0.3 g) | 3.18 | 0.04 | 3.66 | 0.04 | 3.69 | 0.04 | 0.13 | 0.23 |
| 18 | N-4 (1.0 g) S-12 (0.03 g) | S-12 (0.2 g) | 3.20 | 0.04 | 3.70 | 0.04 | 3.73 | 0.04 | 0.13 | 0.24 |

Table 2 indicates that the advantage of the present invention can be obtained by adding the compound [I] and the azaindene group compound according to the present invention to layers other than silver halide emulsion layer. Nevertheless, it is preferable that at least one of these two compounds is added to the silver halide emulsion layer.

Example 3

A multilayer silver halide light-sensitive material was prepared in which following seven layers were formed on a polyethylene-coated sheet. The added amounts shown below are per 1 $m^2$ except that no specific description is made.

First layer . . . solution consisting of 1.2 g of gelatin; 0.35 g (amount converted to metal silver. The same applies correspondingly to the following) of blue-sensitive silver halide emulsion (average particle diameter: 0.8 μm); $1.5\times10^{-3}$ g of S-11; 2, 5-di-t-octylhydroquinone in which $4.5\times10^{-3}$ g of N- 4, 0.9 g of yellow coupler- Y-4, 0.015 g of dioctylphthalate (hereinafter referred to as DOP) were dissolved.

Second layer . . . consisting of DOP in which 0.7 g of gelatin and 0.06 g of HQ - 1 were dissolved.

Third layer . . . consisting of 1.25 g of gelatin; 0.35 g of green-sensitive silver halide emulsion (average particle diameter: 0.5 μm); $1\times10^{-3}$ g of S- 11; and DOP in which $4\times\ ^{-3}$g of N-4, 0.53 g of magenta coupler-m-3, and 0.015 g of HQ-1 were contained.

Fourth layer . . . consisting of DOP in which 1.4 g of gelatin, 0.08 g of HQ- 1, and 0.5 g of ultraviolet absorbing agent (UV-1)were contained.

Fifth layer . . . consisting of 1.4 g of gelatin: 0.3 g of red-sensitive silver halide emulsion (average particle diameter: 0.5 μm), $1\times10^{-3}$ g of S- 11; and DOP in which 0.5 g of cyanogen coupler -C-6 and 0.02 g of HQ-1 were dissolved.

Sixth layer . . . consisting of 1.0 g of gelatin and 0.14 g of DOP in which 0.032 g of HQ- 1 and 0.2 g of UV-1 were dissolved.

Seventh layer . . . containing 0.5 g of gelatin. Sample No. 19 was prepared as above.

In addition, the following sample No. 20 was prepared. Sample 20 . . . the compound S- 11 was not added to the first, third, and fifth layers. $5\times10^{-3}$ g of S- 11 was added to the second layer and $3\times10^{-3}$ g of S- 11 was added to the fourth layer.

The property of the sample thus formed was evaluated in the manner as described in Example 1. The result is shown in Table 3.

[SD-1]

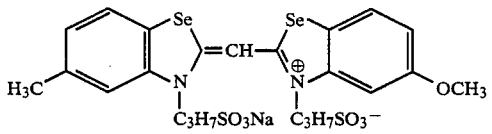

[UV-1]

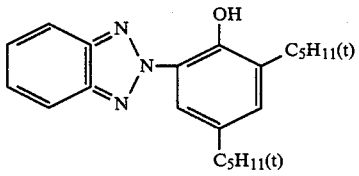

TABLE 3

| Sample No. | Silver halide Emulsion layer | Rapid processing 30 seconds γ | Dmin | 50 seconds γ | Dmin | 60 seconds γ | Dmin | BF contamination-caused variation $\Delta\gamma_B$ | $\Delta\gamma_C$ |
|---|---|---|---|---|---|---|---|---|---|
| 19 | 1st layer (B) | 3.20 | 0.03 | 3.58 | 0.04 | 3.60 | 0.04 | 0.13 | 0.21 |
| | 3rd layer (G) | 3.53 | 0.04 | 3.73 | 0.04 | 3.75 | 0.04 | 0.16 | 0.27 |
| | 5th layer (R) | 3.66 | 0.04 | 3.80 | 0.04 | 3.81 | 0.04 | 0.18 | 0.30 |
| 20 | 1st layer (B) | 3.22 | 0.03 | 3.59 | 0.04 | 3.62 | 0.04 | 0.12 | 0.20 |
| | 3rd layer (G) | 3.55 | 0.04 | 3.74 | 0.04 | 3.76 | 0.04 | 0.15 | 0.27 |
| | 5th layer (R) | 3.68 | 0.04 | 3.81 | 0.04 | 3.82 | 0.04 | 0.19 | 0.31 |

As apparent from Table 3, the advantage of the present invention can be obtained as well by applying the compound according to the present invention to a multilayer silver halide light-sensitive material.

What is claimed is:

1. A silver halide photographic light-sensitive material comprising a support, at least one silver halide emulsion layer containing silver halide crystals, the silver chloride content of which being not less than 80 mol %, at least one compound which is represented by general formula [I], of which acid dissociation constant-(Ka) and the solubility product(Ksp) with silver ion are not more than $1\times10^{-8}$ and not more than $1\times10^{-10}$, respectively;

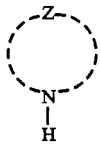

[I]

(wherein Z represents a group of atoms necessary to complete a heterocyclic ring); and at least one azaindene compound having at least one hydroxyl group.

2. The silver halide photographic light-sensitive material of claim 1, wherein the acid dissociation constant (Ka) of the compound of formula [I] is within a range from $1\times10^{-8}$ to $1\times10^{-13}$.

3. The silver halide photographic light-sensitive material of claim 1, wherein Z in formula [I] is a group of atoms necessary to complete a heterocyclic ring selected from a group consisting of a benzimidazole, a benztriazole, a purine, an 8-azapurine and a pyrazolopyrimidine.

4. The silver halide photographic light-sensitive material of claim 1, wherein said azaindene compound is selected from a group consisting of a hydroxytriazaindene, a hydroxytetrazaindene.

5. The silver halide photographic light-sensitive material of claim 1, wherein said silver halide crystals have a cubic crystal habit having a [100] face.

6. A silver halide photographic light-sensitive material comprising a support and, provided thereon, at least one silver halide emulsion layer containing silver halide crystals, the silver chloride content of which being not less than 80 mol %, and at least one azaindene compound having therein at least one hydroxyl group, and at least one non-light-sensitive layer containing at least one compound which is represented by general formula [I], the acid dissociation constant(Ka) of which compound is not more than $1\times10^{-8}$ and the solubility product(Ksp) with silver ion of which is not more than $1\times10^{-10}$;

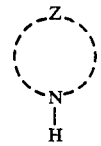

[I]

(wherein Z represents a group of atoms necessary to complete a heterocyclic ring).

7. The silver halide photographic light-sensitive material of claim 6, wherein the acid dissociation constant-(Ka) of the compound of formula [I] is within a range from $1\times10^{-8}$ to $1\times10^{-13}$.

8. The silver halide photographic light-sensitive material of claim 6, wherein Z in formula [I] is a group of atoms necessary to complete a heterocyclic ring selected from a group consisting of a benzimidazole, a benztriazole, a purine, an 8-azapurine and a pyrazolopyrimidine.

9. The silver halide photographic light-sensitive material of claim 6, wherein said azaindene compound is selected from a group consisting of a hydroxytriazaindene, a hydroxytetrazaindene.

10. The silver halide photographic light-sensitive material of claim 6, wherein said silver halide crystals have a cubic crystal habit having a [100] face.

11. A silver halide photographic light-sensitive material comprising a support and, provided thereon, a silver halide emulsion layer containing a yellow dye-forming coupler, a silver halide emulsion layer containing a magenta dye-forming coupler and a silver halide emulsion layer containing a cyan dye-forming coupler, the silver halide contained in the respective silver halide emulsion layers being a silver halide containing silver chloride at a proportion not less than 80 mol %, and said silver halide photographic light-sensitive material containing at least one compound which is represented by general formula [I], the acid dissociation constant(Ka) and the solubility product(Ksp) with silver ion of which compound being not more than $1\times10^{-8}$ is not more than $1\times10^{-10}$, respectively;

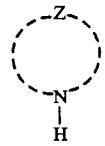

[I]

(wherein Z represents a group of atoms necessary to complete a heterocyclic ring); and at least one azaindene compound having therein at least one hydroxyl group.

12. A method of processing a silver halide photographic light-sensitive material which comprises a step of exposing imagewise a silver halide photographic light-sensitive material to light, said photographic light-sensitive material comprising a support, at least one silver halide emulsion layer containing silver halide crystals, the silver chloride content of which being not less than 80 mol %, at least one compound which is represented by general formula [I], the acid dissociation constant(Ka) and the solubility product(Ksp) with silver ion of said compound being not more than $1\times10^{-8}$ and not more than $1\times10^{-10}$, respectively;

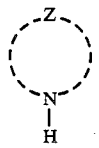

[I]

(wherein Z represents a group of atoms necessary to complete a heterocyclic ring); and at least one azaindene compound having therein at least one hydroxyl group, and a step of processing said exposed photographic light-sensitive material with a color developing solution which is substantially free from bromide ion.

13. The silver halide photographic light-sensitive material of claim 1 wherein said azaindene compound is taken from the group consisting of 2,4-dihydroxy-6-methyl-1,3a,7-triazaindene,
2,5-dimethyl-7-hydroxy-1,4,7a-triazaindene, 5-amino-7-hydroxy-2-methyl-1,4,7a-triazaindene,
4-hydroxy-6-methyl -1,3,3a,7-tetrazaindene,
4-hydroxy-1,3.3a,7-tetrazaindene,
4-hydroxy-6-phenyl-1,3,3a,7-tetrazaindene,
4-methyl-6-hydroxy-1,3,3a,7-tetrazaindene,
2,6-dimethyl-4-hydroxy-1,3,3a,7-tetrazaindene,
4-hydroxy-5-ethyl-6-methyl-1,3,3a,7 tetrazaindene,
2,6-dimethyl-4-hydroxy-5-ethyl-1,3,3a, 7 tetrazaindene,
4-hydroxy-5,6-dimethyl-1,3,3a,7-tetrazaindene,
2,5,6-trimethyl-4-hydroxy-1,3,3a,7-tetrazaindene,
2-methyl-4-hydroxy-6-phenyl-1,3,3a,7 tetrazaindene,
4-hydroxy-6-methyl-1,2,3a,7-tetrazaindene,
4-hydroxy-6-ethyl-1,2,3a,7-tetrazaindene,
4-hydroxy-6-phenyl-1,2,3a,7-tetrazaindene,
4-hydroxy-1,2,3a,7-tetrazaindene,
4-methyl-6-hydroxy-1,2,3a,7-tetrazaindene,
4-methyl-6-hydroxy-1,2,3a,7-tetrazaindene,
7-hydroxy-5-methyl-1,2,3,4,6-pentazaindene,
5-hydroxy-7-methyl-1,2,3,4,6-pentazaindene,
5,7-dihydroxy-1,2,3,4,6-pentazaindene,
7-hydroxy-5-methyl-2-phenyl-1,2,3,4,6pentazaindene, and
5-dimethylamino-7-hydroxy-2-phenyl-1,2,3,4, 6 pentazaindene.

* * * * *